United States Patent [19]

Fredericks

[11] Patent Number: 4,638,616

[45] Date of Patent: Jan. 27, 1987

[54] THERMALLY INSULATIVE SELF-SUPPORTING PANEL

[76] Inventor: Chester P. Fredericks, 3535 W. 72nd Pl., Chicago, Ill. 60629

[21] Appl. No.: 780,654

[22] Filed: Sep. 26, 1985

[51] Int. Cl.[4] ..... E04B 1/80; E04B 1/90

[52] U.S. Cl. ..... 52/397; 52/475; 52/484; 52/785

[58] Field of Search ..... 52/484, 785, 397, 475

[56] References Cited

U.S. PATENT DOCUMENTS

| | | | |
|---|---|---|---|
| 3,084,402 | 4/1963 | Jordan, Jr. et al. | 52/484 X |
| 3,153,304 | 10/1964 | Evangelista | 52/484 X |
| 3,325,954 | 6/1967 | Olson | 52/484 X |
| 3,765,141 | 10/1973 | Shayman | 52/484 X |
| 4,428,454 | 1/1984 | Capaul et al. | 52/484 X |

*Primary Examiner*—Alfred C. Perham
*Attorney, Agent, or Firm*—Norman B. Rainer

[57] ABSTRACT

A ceiling panel adapted to be supported by its edges from a ceiling-suspended framework provides improved thermal barrier characteristics and resists upward displacement by strong air currents such as generated by fires. The panel is comprised of a rigid gypsum board center portion of rectangular perimeter, a lower layer of inorganic material having a downwardly disposed contoured surface, and an upper stratum of thermally insulative material. A shoulder is formed between the perimeters of the center portion and lower layer. A resilient sealing strip attached to the shoulder causes the panel to seat firmly upon the ceiling-suspended framework.

6 Claims, 3 Drawing Figures

THERMALLY INSULATIVE SELF-SUPPORTING PANEL

BACKGROUND OF THE INVENTION

This invention relates to panels adapted to be used in forming interior surfaces of buildings, and is more particularly concerned with large rectangular panels adapted to be held by a framework to form a ceiling.

Structural panels used in forming finished interior walls and ceilings of buildings are generally comprised of gypsum boards, wet felted fibrous boards, slab structures of melt-spun mineral fibers, panels of interadhered wood chips, and other well known materials. The term "finished" is intended to denote a surface which requires either no further treatment or merely a superficial treatment, such as painting, to achieve final form. Ceiling panels, particularly those adapted to be held by a grid-type framework which supports the panels at their peripheral edges, are generally susceptible to sagging, especially when made in large area dimensions such as 2 feet square, or 2 feet by four feet.

Efforts to alleviate the sagging problem by minimizing panel weight have generally led to reduced thermal barrier properties, and have also increased fire risks because the light weight panels are displaced upwardly by pressures or thermal convection currents associated with a fire, thereby facilitating spread of the fire. Embossing techniques have been used to increase the rigidity of light weight ceiling panels. Although such techniques minimize sagging and provide an aesthetically pleasing decorative effect, they have no effect on thermal conductivity through the panel and the lifting of the panel in a fire. When a downwardly disposed surface of a ceiling panel is of a porous nature, as is the case when fibrous materials are used, the surface collects airborne dirt and is non-cleanable.

It is accordingly an object of the present invention to provide a ceiling panel capable of being supported by its peripheral edges without sagging.

It is another object of this invention to provide a ceiling panel as in the foregoing object having improved thermal barrier characteristics.

It is a further object of the present invention to provide a ceiling panel of the aforesaid nature which will resist upward displacement by strong convection currents.

It is still further object of this invention to provide a ceiling tile of the aforesaid nature having a decorative non-porous cleanable downwardly disposed surface.

It is yet another object of the present invention to provide a ceiling panel of the aforesaid nature of rectangular perimeter and adapted to be held by a ceiling-suspended grid-type framework.

These objects and other objects and advantages of the invention will be apparent from the following description.

SUMMARY OF THE INVENTION

The above and other beneficial objects and advantages are accomplished in accordance with the present invention by a ceiling panel comprised of:

(a) a rigid center portion of rectangular perimeter comprised of gypsum board having flat upper and lower surfaces, (b) a lower layer of compact inorganic material associated with the lower surface of said center portion, having a downwardly disposed contoured surface and having a perimeter uniformly inwardly displaced from the perimeter of said center portion, thereby forming a shoulder, (c) a resilient flat sealing strip associated with said shoulder as a continuous border, and (d) an upper stratum of low heat transfer material disposed upon the upper surface of said center portion.

By virtue of the gypsum board, which may have a thickness between about ¼" and ½", sufficient rigidity is imparted to the panel to prevent sagging. The expression "gypsum board" is intended to denote commercially available products, sometimes referred to as "sheet rock", comprised of compressed gypsum sandwiched between two surface layers of paper-like composition. Fibrous reinforcement is sometimes incorporated into the gypsum.

The layer of compact inorganic material may be comprised of gypsum alone or in admixture with other ingredients such as vermicilite and "Fiberglas". Said lower layer may be separately produced by molding or rolling techniques, and is attached to the lower surface of the gypsum board preferably by use of adhesives.

The resilient sealing material is preferably of a resilient foam construction and is adhered to the shoulder. By virtue of its placement and configuration, the sealing material is adapted to make substantially air-tight contact with the framework of the supporting grid.

The combined weight of the center portion and lower layer causes the panel to offer considerable resistance to upward displacement by the pressures and convective currents generated by a fire within a building.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
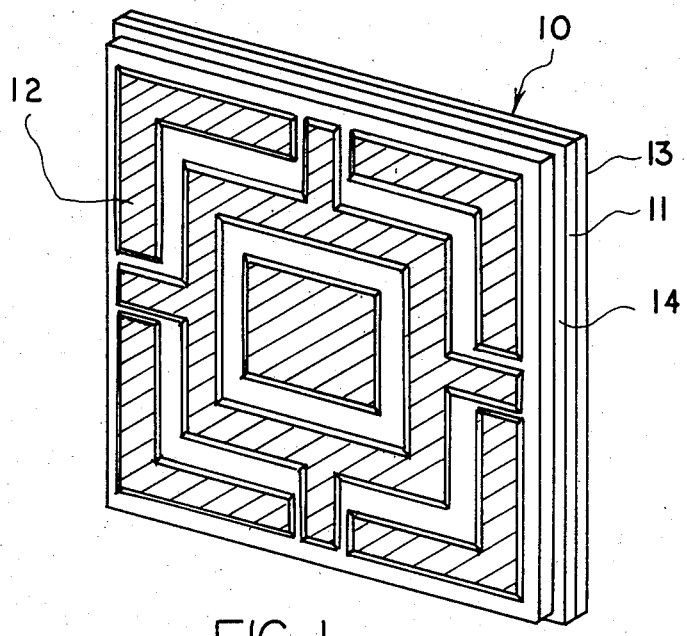
FIG. 1 is a perspective view of an embodiment of the panel of the present invention.

Referring to the drawing, a panel 10 of the present invention is shown comprised of rigid center portion 11, lower layer 12, upper stratum 13 and sealing strip 14.

Center portion 11 is comprised of a sheet of ½" thick gypsum board cut to a 2 foot square perimeter and having flat upper and lower surfaces 15 and 16, respectively.

Lower layer 12, having a thickness of ½", measured between its downwardly disposed surface 17 and top surface 18, and having been made by a molding operation, is centered upon lower surface 16 of center portion 11 and held thereto by conventional adhesives. Alternatively, said lower layer may be molded in one operation to the gypsum board without use of adhesives. Said downwardly disposed surface is contoured so as to provide a visually appealing decorative effect. The decorative effect may involve either a random pattern which is not interactive with contiguously placed panels, or an oriented pattern which interacts with adjacent panels to produce a repetitive effect. The decorative effect may be in the form of symbols such as a company logo, or designs of otherwise special significance. The downwardly disposed surface preferably has a smooth, non-porous texture which permits painting and cleaning. Fire retardent paints or other functional coatings may be applied to the downwardly disposed surface.

Said lower layer may be produced for example from plaster of paris, an anhydrous powder form a calcium sulfate, which when mixed with water hardens to a hydrated state ($CaSO_4.2H_2O$) known as gypsum. Other ingredients may be mixed with the plaster of paris prior to the molding operation, typical ingredients being fibrous materials which increase tensile strength, and porous materials such as perlite and vermiculite for weight control. The outer perimeter of the lower layer is smaller than the perimeter of the center portion. Each edge of the lower layer is therefore uniformly inwardly displaced from the corresponding edge of the center portion. The extent of such displacement is preferably in the range of about ¼" to 2". The displacement zones constitute a shoulder 19 which surrounds said lower layer.

A resilient flat sealing strip 14, comprised of ¼" thick foam rubber, is adhered to shoulder 19 to form a continuous border.

Upper stratum 13 is comprised of a relatively light weight substrate of uniform thickness having trapped air spaces. Particularly preferred substrates are closed cell plastic foams such as may be produced from polystyrene and polyethylene as extruded or molded slab stock. In order to minimize flammability, said plastics may be made to contain well-known fire-retardant additives generally comprised of bromine and phosphate-containing compounds. Alternatively, the upper stratum may be fabricated of a batt of fibrous material such as rock wool or fiberglas.

The function of the upper stratum is to minimize conductive heat transfer through the ceiling panel. The relative heat transfer properties of a given material is generally expressed by a "k" factor which represents the number of BTU units of heat which will pass per hour per square foot per inch of thickness through the material per Fahrenheit degree of thermal gradient across the material. Typical values of k factors of materials used for the upper stratum will generally be less than 0.35. As a typical comparative example, low density corkboard with no added binder has a k factor of 0.26.

Figure 2:
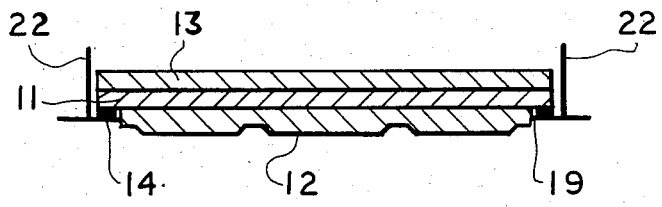
FIG. 2 is a sectional view taken along the line 2—2 of FIG. 1.
Figure 3:
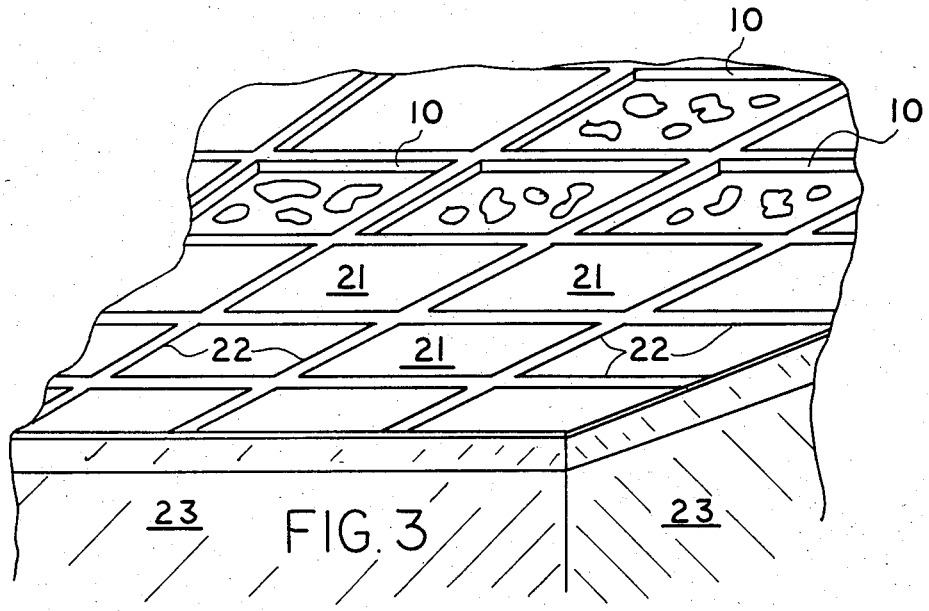
FIG. 3 is a perspective view of a number of the panels of FIG. 1 shown assembled in a suspended grid-type framework.

As shown in FIG. 3, the panels 10 of this invention are designed to seat by gravity within the rectangular grid spaces 21 of a metal framework 22 suspended from a ceiling and bordered by vertical walls 23. The seated panels interact with the framework as shown in FIG. 2 whereby sealing strip 14 is compressively interposed between center portion 11 and said framework. By virtue of their low thermal conductivity and the manner in which they prevent air flow around their edges, the panels maintain the thermal quality of the air in the room below the ceiling, thereby resulting in the saving of energy required for heating or cooling said air. In order that the panels resist upward displacement by pressure effects or convective currents which might be encountered during a fire, it has been found that the weight and outer perimeter of the panel must be such that the sealing strip experiences a downward force between about 1.5 and 4.5 pounds per linear foot. For example, a panel of this invention measuring two feet square and weighing 25 pounds will provide a downward force upon the sealing strip of 3.12 pounds per foot of sealing strip.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A ceiling panel comprised of:

(a) a rigid center portion of rectangular perimeter comprised of gypsum board having flat upper and lower surfaces, (b) a lower layer of compact inorganic material associated with the lower surface of said center portion, having a downwardly disposed contoured surface and having a perimeter uniformly inwardly displaced from the perimeter of said center portion, thereby forming a shoulder, (c) a resilient flat sealing strip associated with said shoulder as a continuous border, and (d) an upper stratum of low heat transfer material disposed upon the upper surface of said center portion, (e) the weight and perimeter of the panel being such that the sealing strip experiences a downward force between about 1.5 and 4.5 pounds per linear foot.

2. The panel of claim 1 wherein said contoured surface is of smooth, substantially non-porous texture amenable to painting and cleaning.

3. The panel of claim 2 wherein said gypsum board has a thickness between ¼" and ½".

4. The panel of claim 3 wherein said lower layer is attached to the lower surface of said gypsum board by use of adhesives.

5. The panel of claim 3 wherein said lower layer is molded onto said gypsum board.

6. The panel of claim 3 wherein said sealing strip is comprised of a resilient foam material.

* * * * *